United States Patent [19]

Everhart

[11] 4,044,438

[45] Aug. 30, 1977

[54] APPARATUS AND METHOD FOR FORMING YARN BALLS

[75] Inventor: John R. Everhart, Mount Airy, N.C.

[73] Assignee: Renfro Corporation, Mount Airy, N.C.

[21] Appl. No.: 706,904

[22] Filed: July 19, 1976

[51] Int. Cl.[2] ..... D04D 7/06

[52] U.S. Cl. ..... 28/147

[58] Field of Search ..... 28/2; 223/46; 100/6

[56] References Cited

U.S. PATENT DOCUMENTS 1,965,464 7/1934 Koehler ..... 28/2

*Primary Examiner*—Louis K. Rimrodt

*Attorney, Agent, or Firm*—Bell, Seltzer, Park & Gibson

[57] ABSTRACT

Lengths of yarn are bound together in the center to provide relatively short yarn bundles for use in forming yarn balls of the type usually referred to as "poms." A forming wheel is supported for rotation and includes equally spaced forming stations about the periphery for receiving yarns and arranging them into a generally parallel, composite arrangement. The wheel is indexed in a step-by-step manner a distance equal to the distance between successive forming stations and the composite arrangement of yarns is gripped and confined at each of the spaced forming stations. Binder elements are sequentially applied around the bundle of yarns as the successive forming stations move into alignment with a binder applying head. The bound yarns are then cut between successive forming stations to provide lengths of yarn bound together in the center and held in each forming station. The cut and bound together bundles of yarn are then successively stripped from the forming wheel and removed from the machine.

14 Claims, 9 Drawing Figures

APPARATUS AND METHOD FOR FORMING YARN BALLS

This invention relates generally to an apparatus and method for forming relatively short bound together lengths of yarns which are used in forming yarn balls of the type usually referred to as "poms."

Various types of machines have been proposed for forming this type of yarn ball. In most machines of this type, the yarns follow a substantially straight line path of travel as the yarns are gathered together, a length of the yarns is drawn forwardly, a binder element applied thereto, and then the yarns are beyond the binder element so that relatively short yarn bundles are formed on an individual basis. This type of straight line operation limits the speed at which the bound together yarns can be formed and also requires complicated mechanisms for maintaining accurate control of the bound together yarns as they are being produced.

With the foregoing in mind, it is an object of the present invention to provide an apparatus and method for forming bound together yarn lengths for use in forming yarn balls at a high production rate while maintaining accurate control by continuously gripping and confining the bound together yarns as they are sequentially formed at a rapid rate.

In accordance with the present invention, a series of successive work stations is provided for performing the various procedures incident to formation of the yarn balls. A bundle of individual yarns is guided and arranged into a generally parallel, composite arrangement and fed into spaced apart gripper and confining means carried by a forming wheel which is rotated in a step-by-step manner. The composite arrangement of yarns is retained on the forming wheel and maintained under accurate control at all times until the bound together and cut yarn lengths are stripped from the forming wheel. Successive work stations are provided adjacent the periphery of the forming wheel so that the successive gripper and confining means are moved to and remain at the work stations between each step-by-step movement of the forming wheel. The gripper and confining means provide forming stations into which the yarn bundle is guided and maintained in the composite arrangement in a U-shaped anvil at each forming station. A binder applying head is supported adjacent the periphery of the forming wheel for applying a wire binder around the bundle of yarns as each forming station successively moves into alignment with the binder applying head.

As the wire binders are applied around the bundle of yarns in spaced apart relationship and at the successive forming stations, a chain is formed of the bundled yarns to draw additional yarn from the supply creel as the forming wheel is moved in a step-by-step manner. A cutter blade is provided adjacent the periphery of the forming wheel and is spaced from the binder applying head for successively cutting the bound together bundle of yarns between successive forming stations and during the non-movement period following each step of movement of the forming wheel. The individual bundled together lengths of yarn are stripped from the forming wheel at a location spaced from the cutter blade and are removed to a suitable collection point by suction means.

Other objects and advantages will appear as the description proceeds when taken in connection with the accompanying drawings, in which FIG. 1 is an isometric view of the machine of the present invention;

Figures 5, 6:
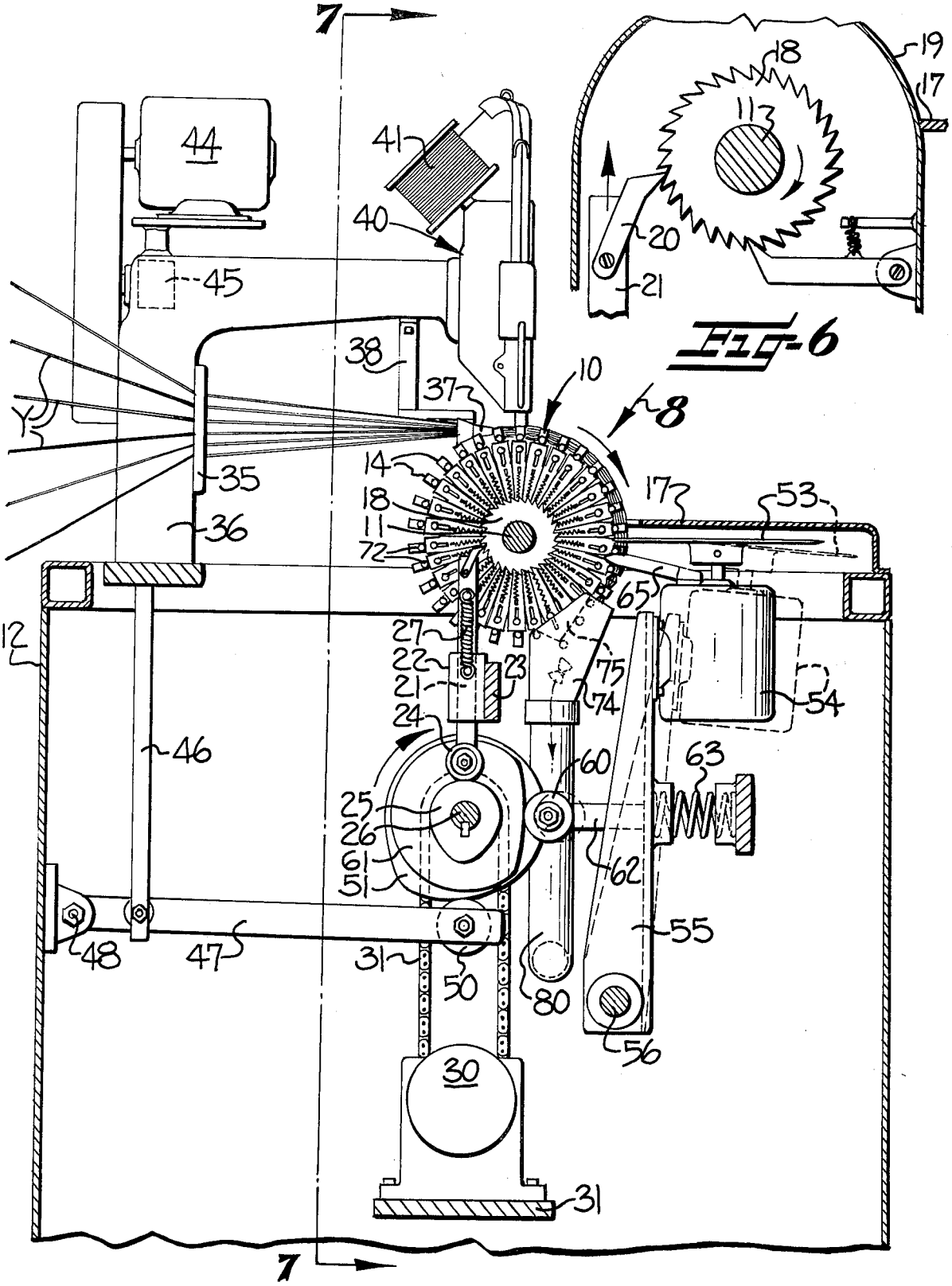
FIG. 5 is a longitudinal vertical sectional view through the machine taken substantially along the line 5—5 in FIG. 1.
FIG. 6 is an enlarged vertical sectional view illustrating the drive means for moving the forming wheel in a step-by-step manner.
Figure 8:
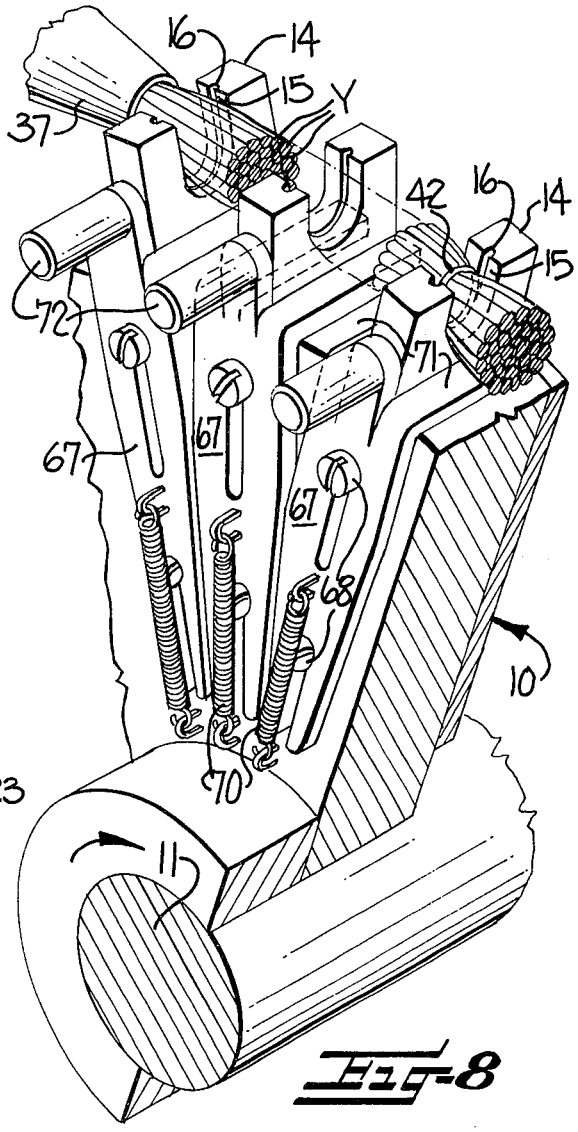
Figure 9:
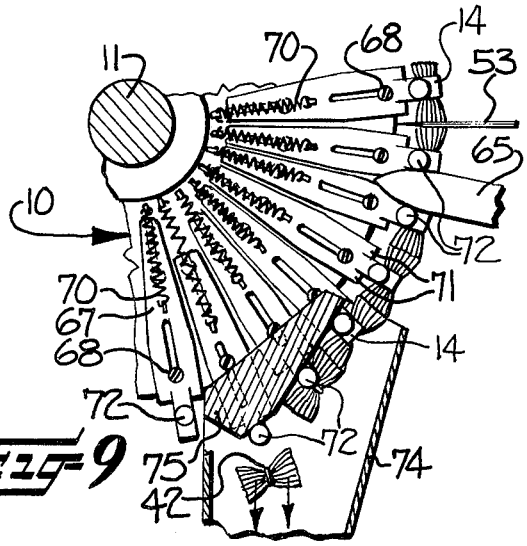

FIG. 8 is an enlarged fragmentary isometric view of a portion of the forming wheel, looking in the direction of the arrow 8 in FIG. 5, and illustrating the details of the equally spaced forming stations around the periphery of the forming wheel; and FIG. 9 is a fragmentary elevational view of a portion of the forming wheel, illustrating the manner in which the yarn chain is first cut between the spaced apart bound locations and then the manner in which the individual cut bundles are stripped from the forming wheel to be removed to a collection point by suction means.

Figure 1:
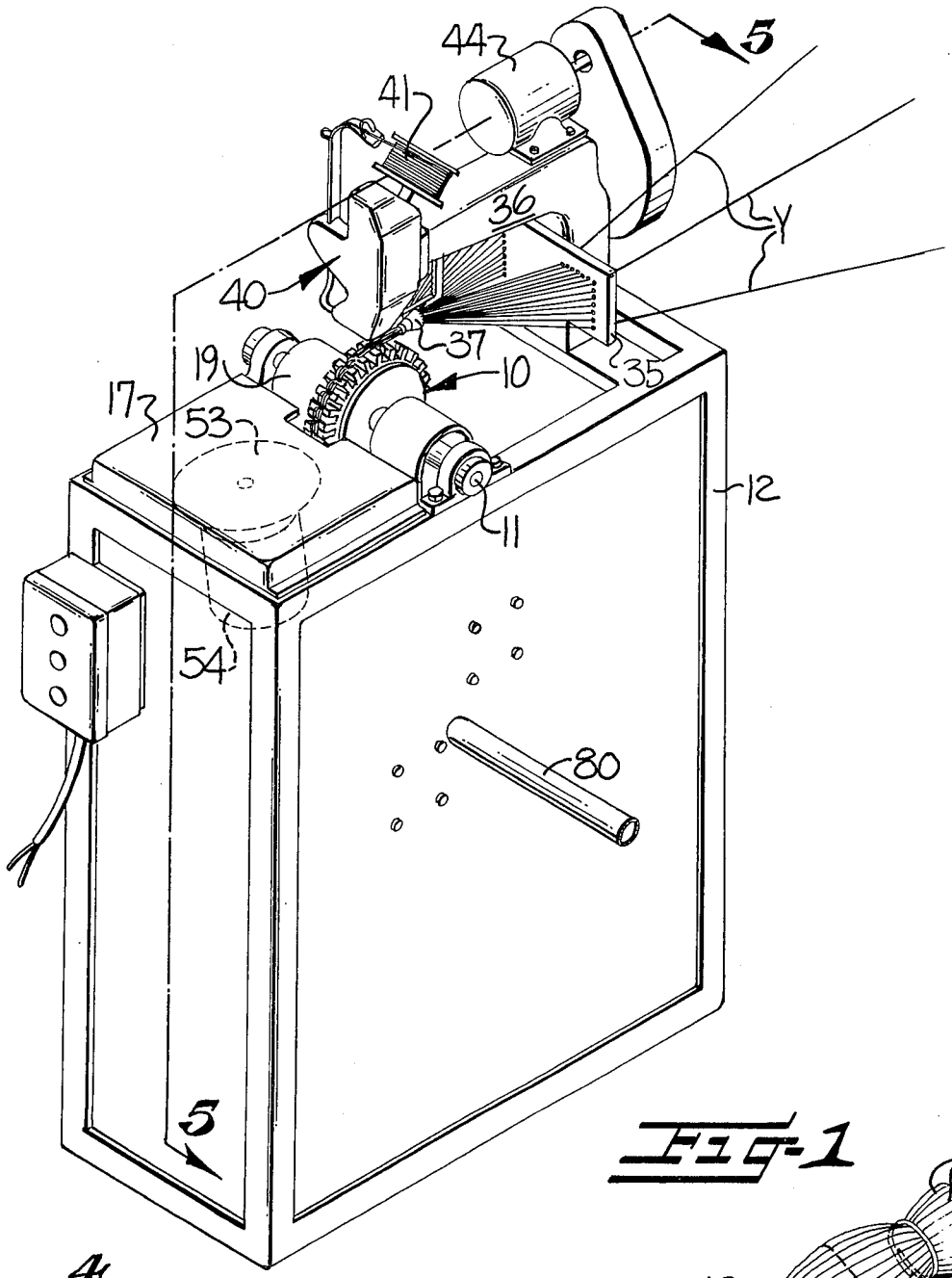

As illustrated in FIG. 1, the machine is very compact and occupies very little floor space. The machine is of simple construction and may be operated with very little attention by an unskilled operator. The machine includes yarn feeding means, illustrated as a forming wheel, broadly indicated at 10, fixed on a support shaft 11 which is journaled at opposite ends for rotation in bearings fixed on the enclosed frame 12 of the machine. A plurality of forming stations are equally spaced about the periphery of the forming wheel 10 for gripping and confining a multiplicity of yarns in a generally parallel, composite arrangement. Each forming station includes a rectangular anvil or female die 14 with its inner end fixed to the wheel 10 and extending outwardly in a radial direction. Each anvil 14 includes a substantially U-shaped opening 15 extending downwardly from its outer end (FIG. 8) with a U-shaped groove 16 extending around the medial portion of the U-shaped opening 15.

Drive means is provided for moving the forming wheel 10 in a step-by-step manner a distance equal to the distance between successive forming stations and includes a racking or indexing gear 18 (FIGS. 6 and 7) which is fixed on the shaft 11 and is provided with a guard cover 19 (FIGS. 1 and 6). The guard cover 19 is supported adjacent a guard cover 17 (FIG. 1) for the cutter blade, to be presently described. A racking pawl 20 is pivotally supported on the upper end of a slide plate 21 (FIG. 6) which is supported for vertical sliding movement in a slide bracket 22, fixed on a cross-frame member 23. A cam roller 24 is supported on the lower end of the slide plate 21 and rides on an operating cam 25 which is fixed on a cam shaft 26. The cam roller 24 is maintained in resilient engagement with the cam 26 by a compression spring 27 (FIG. 5), the upper end of which is connected to the slide plate 21 and the lower end of which is connected to the slide bracket 22.

Figure 7:
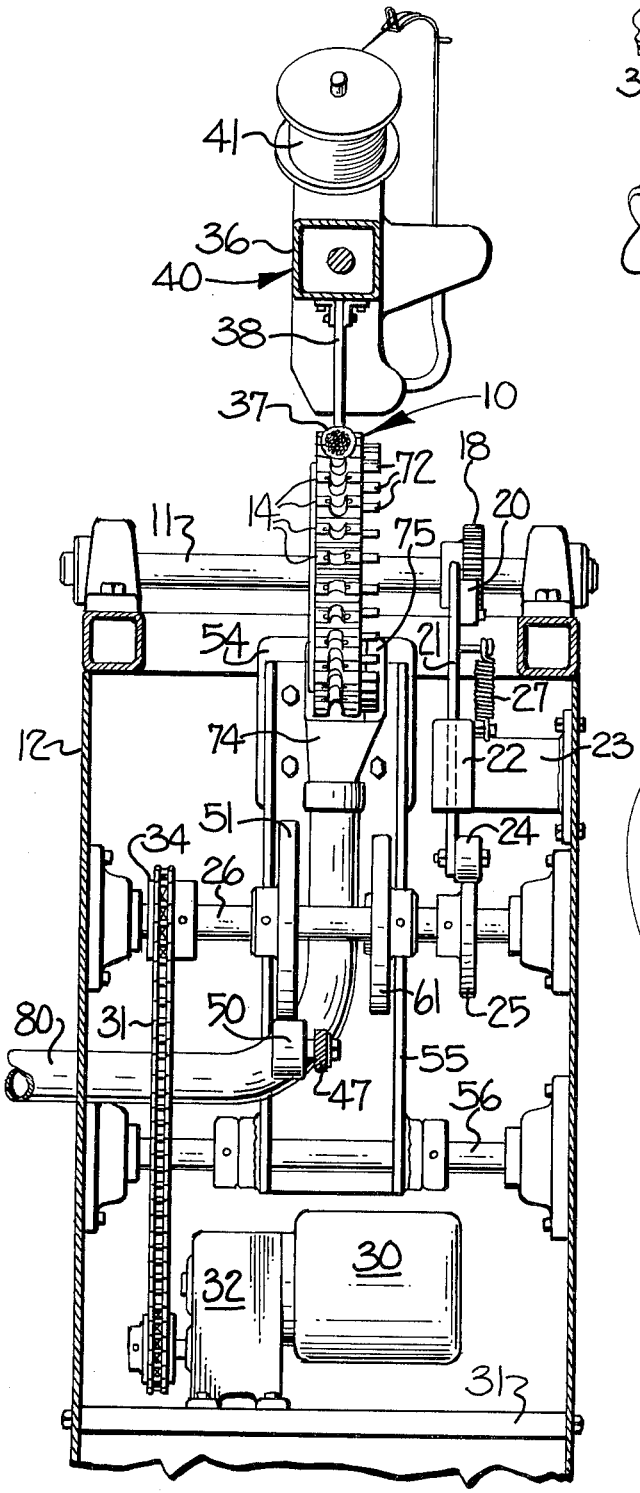
FIG. 7 is a transverse vertical sectional view taken along the line 7—7 in FIG. 5.

A main drive motor 30 is supported on a cross-frame member 31 and is drivingly connected to the cam shaft 26 by a sprocket chain 31 and a drive sprocket 34 fixed on the cam shaft 26 (FIGS. 5 and 7). A gear reduction unit 32 (FIG. 7 ) is provided on the drive motor 30 so that the cam shaft 26 is rotated at the desired speed. Thus, the operating cam 25 raises the roller 24 and the racking pawl 20 a sufficient distance to move the forming wheel 10 a single step in rotation with each complete rotation of the cam shaft 26. As will be noted in FIG. 5, the cam 25 is shaped in such a manner that a step in movement is imparted to the forming wheel 10 during approximately 90° of rotation of the cam shaft 26 and the forming wheel 10 remains in a stationary position for the remaining 270° rotation of the cam shaft 26.

Means is provided for receiving a multiplicity of yarns, indicated at Y in FIG. 1 from a suitable yarn supply creel, not shown, and arranging those yarns into a generally parallel, composite arrangement and guiding them inwardly and along a path tangent to a portion of the periphery of the forming wheel 10. As illustrated in FIG. 1, the guiding means includes a yarn guide eyelet board 35 which is fixed in its medial portion on the vertical portion of a support housing 36 of a binder applying head, to be presently described. A funnel-shaped guide 37 (FIGS. 5 and 8) is fixed on the lower end of a support arm 38, the upper end of which is fixed on the housing 36 so that the individual yarn ends Y are gathered together and guided into the U-shaped openings 15 of the anvils 14 as they successively move with step-by-step rotation of the forming wheel 10, in the manner illustrated in FIG. 8.

Figure 3:
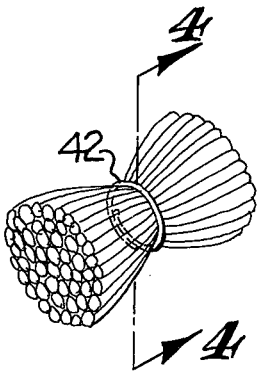
FIG. 3 is an isometric view of a single cut bundle of lengths of yarn which is bound in a central portion thereof by a wire binder.
Figure 4:
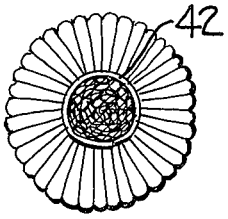
FIG. 4 is a vertical sectional view through the central portion of the cut bundle of lengths of yarn, being taken substantially along the line 4—4 in FIG. 3.
Figure 2:
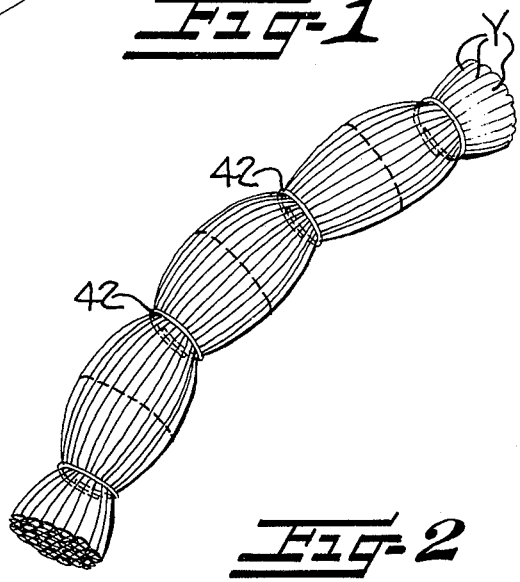
FIG. 2 is an isometric view of the chain of yarns bundled together at spaced apart locations and removed from the machine, and indicating in dotted lines the locations where the bundle will be cut.

Binder applying means, in the form of a conventional type of staple applying head broadly indicated at 40, is supported on the forward free end of the housing 36. The binder applying head 40 is spaced from the yarn guide means and is supported adjacent the periphery of the forming wheel 10. The staple applying head 40 is aligned with successive forming stations as they are stationary between movements of the forming wheel 10. The staple applying head 40 is provided with a wire supply spool 41 and the usual plunger or male die for moving downwardly bent opposed ends of a cut piece of wire downwardly into the U-shaped groove 16 in the anvil 14 so that the binder element, in the form of a wire 42 compresses and is applied around the bundle of yarns at each successive forming station as it moves into alignment therewith. As illustrated in FIG. 3, the binder wire 42 encircles the bundle of yarns and opposed ends overlap in side-by-side relationship to tightly bind together the individual yarns in spaced apart relationship, the spacing of the binder wires 42 being equal to the spacing between the anvils 14 and being tightly engaged in the U-shaped groove 16 in each U-shaped opening 15. The bound together yarn bundle thus forms a chain which draws additional yarn from the yarn supply creel when the forming wheel 10 is indexed. Also, the bundle of yarns with the spaced apart binder wires 42 is securely controlled and held in the anvils while the forming wheel 10 is indexed.

The binder applying head 40 is operated by a drive motor 44 (FIG. 5) which is drivingly connected to a clutch member 45, indicated in dotted lines in FIG. 5. The clutch 45 is periodically actuated to operate the binder element driving plunger and apply the binder wire 42 around the bundle of yarns as each forming station moves into alignment with the binder applying head 40. The upper end of an operating link 46 is operatively connected to the clutch 45 (FIG. 5) and its lower end is connected to a medial portion of an operating lever 47, the outer end of which is pivotally supported as at 48 on the machine housing 12. A cam roller 50 is supported for rotation on the other end of the operating lever 47 and engages an operating cam 51 fixed on the cam shaft 26. As will be noted in FIG. 5, the shape of the cam 51 causes the binder applying head 40 to be actuated one time during each rotation of the cam shaft 26. The wire binder element 42 is applied to the yarn bundle as the next successive anvil 14 moves in alignment with the binder applying head 40 and while the anvil 14 is maintained in a stationary position between indexing moves of the forming wheel 10.

Cutter means is positioned adjacent the periphery of the forming wheel 10 and is spaced from the binder applying head 40 for sequentially cutting the bundle of yarns at a point midway between successive forming stations and following each step of movement of the forming wheel 10. The cutting means includes a circular cutter blade 53 (FIG. 5) which is fixed on the shaft of a drive motor 54. The drive motor 54 is fixed on the upper end of a bifurcated cutter motor support arm 55, the lower end of which is pivotally supported on a support shaft 56. Opposite ends of the support shaft 56 are supported in suitable bearings at opposite sides of the enclosed frame 12 (FIG. 7). A cam roller 60 (FIG. 5) rides against the outer surface of an operating cam 61 which is fixed on the cam shaft 26. The cam roller 60 is supported for rotation on one end of a support arm 62, the other end of which is fixed on the cutter motor support arm 55. A compression spring 63 normally maintains the cam roller 60 in engagement with the cam 61.

As illustrated in FIG. 5, the cam 61 is provided with one low position so that the cutter blade 53 and drive motor 54 are normally maintained in a non-cutting position, as illustrated in dotted lines in FIG. 5, during the major portion of the rotation of the cam shaft 26. The cutter blade 53 is moved inwardly to the solid line position shown in FIG. 5 one time during each rotation of the cam shaft 26. By comparing the positions of the operating cams 25, 51 and 61 on the cam shaft 26, it will be noted that the cutter blade 53 is moved inwardly to cut the yarn bundle, as illustrated in FIG. 9, while the forming wheel 10 is in a stationary position and the cutter blade 53 cuts through the bundle of yarns at a position centrally of and between the adjacent pair of anvils 14.

Cam means is provided for insuring that the feed wheel 10 is in the proper position when the cutter blade 53 moves inwardly to cut the bundle of yarns and includes an elongated positioning cam 65 (FIGS. 5 and 9) having curved opposite side cam surfaces on its inner free end and with its outer end being fixed on the drive motor 54. The manner in which this cam member 65 operates to insure alignment of the feed wheel 10 will be presently described.

Stripper means is spaced from the cutter blade 53 (FIGS. 5 and 9) for successively removing the cut bundles of yarn lengths bound by the binder wire 42 from the forming wheel 10. The stripper means includes a stripper plate 67 (FIG. 8) supported for radial sliding movement by screws 68 fixed in one side of the forming wheel 10 and operating in slots in the stripper plate 67. The stripper plate 67 is normally maintained in an innermost position by a compression spring 70, the inner end of which is fixed on one side of the feed wheel 10 and the other end of which is fixed on the stripper plate 67. The stripper plate 67 includes a pair of stripper arms 71 extending at right angles from the upper end of the stripper plate and extending adjacent opposite sides of the corresponding anvil 14 and along the outer surface of the feed wheel 10, beneath the bundled yarns. A cam roller 72 is rotatably supported on the outer portion of the stripper plate 67 and extends outwardly therefrom.

As the forming wheel 10 is indexed in a step-by-step manner, the outer peripheral portion thereof moves into a funnel-shaped stripper housing 74 (FIGS. 5 and 9) so that the cam rollers 72 of successive forming stations engage a cam 75 and move the stripper plates 67 outwardly. The stripper arms 71 engage the bundle of cut yarn ends adjacent opposite sides of the anvil 14 and force the cut and bound yarn bundle out of the anvil 14 and into the funnel-shaped housing 74, as illustrated in FIG. 9.

Suction means is positioned adjacent the stripper means for removing the cut bundles of yarn from the machine and depositing them in a suitable collection bin or the like. The suction means includes a suction tube 80 connected at one end to the funnel-shaped housing 74 and extending through one side of the closed frame 12. The opposite end of the suction tube 80 extends to a suitable collection bin, not shown. Thus, the cut and bound yarn bundles are stripped from the feed wheel and deposited in the suction tube 80 so that they are removed from the machine and collected at a suitable collection location adjacent to the machine for further processing to form yarn balls. The cut bundles of yarn may be bleached and/or dyed and tumble dried to complete the formation of the ornamental yarn ball, commonly referred to as a "pom." These yarn balls may be used for various decorative purposes and at present are very popular for use as attachments to low cut socks. In such use the yarn ball is attached at the upper rear edge of the sock to aid in preventing the sock from slipping down into the shoe and to provide a decoration above the rear upper edge of the shoe.

The cam arm 65 is properly positioned so that it moves inwardly with inward movement of the cutter blade 53 and moves between adjacent pairs of the cam rollers 72 at adjacent forming stations, as illustrated in FIG. 9. The cam arm 65 insures that the feed wheel 10 is properly positioned for the cutter blade 53 to cut the yarns at a point equidistance between each of the forming stations. Thus, if the feed wheel 10 is not indexed the proper amount by the drive means, the feed wheel 10 will be moved slightly by the cam arm 65 to center the cutter blade 53 before it engages the bound yarns.

With the parts of the machine in the position illustrated in FIG. 5, the cutter blade 53 is completing the cutting of the yarn bundle and the cutter blade 53 is in its innermost position. With continued clockwise rotation of the cam shaft 26, the cam 61 will move the motor 54 and the cutter blade 53 outwardly to the dotted line position. The cam 25 will then raise the cam roller 24 to impart a step in movement to the feed wheel 10 to position the next successive forming station and anvil 14 in alignment with the binder applying head 40. While the forming wheel 10 is in a stationary position, the binder applying head 40 is actuated by the cam 51 to apply the binder wire 42 around the bundle of yarns and compress the same in the U-shaped opening of the anvil 14. With continued rotation of the cam shaft 26, the cutter 53 is moved inwardly by the cam 61 and spring 63 to cut the bundled yarns between the next pair of adjacent forming stations and before the feed wheel 10 is indexed to apply a binder wire at the next forming station. During each rotation of the cam shaft 26, a single step in movement is applied to the feed wheel 10, a binder wire is applied by the binder applying head 40, the yarn bundle is cut between adjacent forming stations, and a cut and bound bundle of yarn is stripped from the feed wheel and deposited in the funnel-shaped housing 74 to be removed from the machine through the suction tube 80.

Thus, the apparatus and method of the present invention successively carries out the necessary steps in forming bound together yarn lengths for use in forming yarn balls in such a manner that the bound together yarn lengths may be formed in a fast and efficient manner. The machine operates to carry out the required series of successive steps in an uncomplicated manner while the yarn bundle is maintained under accurate control at all times. The continuous rotation of the cam shaft 26 insures the proper timing of each of the successive steps required in forming the bound together yarn lengths at a high production rate.

In the drawings and specification there has been set forth a preferred embodiment of the invention, and although specific terms are employed, they are used in a generic and descriptive sense only and not for purposes of limitation.

That which is claimed is:

1. Apparatus for forming relatively short yarn bundles for use in making yarn balls characterized by a series of successive work stations at which the various procedures incident to formation of the yarn bundles are performed, said apparatus comprising a. means for receiving a multiplicity of yarn and arranging those yarns into a generally parallel, composite arrangement, b. means operatively associated with and in spaced relation to said yarn arranging means for sequentially applying a binder element around the composite yarn arrangement at predetermined points spaced apart along the length of the yarns a distance equal to the desired length of the yarn bundles being formed;

c. cutting means disposed in spaced relation to said binder applying means for sequentially severing the composite yarn arrangement between adjacent binder elements to form the composite yarn arrangement into relatively short yarn bundles; and d. feeding means for feeding the composite yarn arrangement from said yarn arranging means to said binder applying means and then to said cutting means, said feeding means including 1. spaced apart gripper means for receiving and grippingly engaging successive incremental lengths of the composite yarn arrangement to maintain the yarns in the composite arrangement until the binder elements are applied and to hold the bound lengths in position for severing to form the yarn bundles, and 2. drive means for successively indexing said spaced apart gripper means into successive operative association with said yarn arranging means, binder applying means and cutting means.

2. Apparatus according to claim 1 including stripper means disposed in spaced relation from said cutting means and being operable to successively remove the cut and bound lengths of yarn from said gripper means.

3. Apparatus according to claim 2 including suction means operatively associated with said stripper means for removing the stripped and bound lengths of yarn from the apparatus.

4. Apparatus for forming bound together yarn lengths for use in forming yarn balls comprising a. a forming wheel supported for rotation and including a plurality of ball forming stations equally spaced about the periphery of said wheel, b. drive means for moving said forming wheel in a step-by-step manner a distance equal to the distance between successive forming stations, c. means for guiding a bundle of yarns in tangential alignment with the path of movement of said forming stations so that the bundle of yarns engages and extends between a plurality of said spaced apart forming stations, d. binder applying means located adjacent the periphery of said forming wheel and in alignment with successive forming stations between movements of said forming wheel for compressing and applying a binder element around the bundles of yarns at successive forming stations as said forming stations move into alignment therewith, e. cutter means positioned adjacent the periphery of said forming wheel and spaced from said binder applying means for successively cutting the bundle of yarns between successive forming stations and following each step of movement of said forming wheel, and f. stripper means spaced from said cutter means for successively removing the cut bundles of yarn bound by said binder element.

5. Apparatus according to claim 4 wherein said cutter means (e) comprises a circular cutter blade, and including means for moving said cutter blade in substantially a radial direction relative to said forming wheel for successively cutting the bundle of yarns between successive forming stations and following each step of movement of said forming wheel.

6. Apparatus according to claim 4 including suction means positioned adjacent said stripper means for removing the bound together bundles of yarn from the apparatus and for feeding them to a suitable collection location.

7. Apparatus according to claim 4 wherein each of said ball forming stations comprises a substantially rectangular anvil fixed to and extending outwardly in a radial direction from said forming wheel, said anvil including a substantially U-shaped opening for receiving the bundle of yarns therein, and a U-shaped groove extending around the medial portion of said U-shaped opening.

8. Apparatus according to claim 7 wherein said means (c) comprises a funnel-shaped guide having an exit end positioned in alignment with the U-shaped openings in said anvils for directing the bundle of yarns into said U-shaped openings as said anvils are moved in a step-by-step manner.

9. Apparatus according to claim 7 wherein said binder means (d) comprises a binder forming and applying head for moving opposed legs of a wire binder into said U-shaped groove in said U-shaped opening so as to compress the bundle of yarns and to wrap said wire binder around said bundle of yarns.

10. Apparatus according to claim 4 wherein said stripper means (f) comprises a stripper plate supported for radial sliding movement on said feed wheel and adjacent to each of said anvils, each of said stripper plates including a pair of stripper arms extending adjacent opposite sides of the corresponding anvil, resilient means normally urging said stripper plate inwardly with said stripper arms engaging the periphery of said feed wheel, a cam roller carried by said stripper plate and extending outwardly therefrom, and cam means engageable with said cam roller for moving said stripper plate outwardly so that said stripper arms engage and move the bound together bundle of yarns out of said U-shaped opening in said anvil.

11. Apparatus according to claim 10 wherein said cutter means includes a circular cutter blade, a drive motor connected to said circular cutter blade, and cam means operable in timed relationship to movement of said cutter blade in a substantially radial direction relative to said feed wheel, said cam means being movable between adjacent pairs of said cam rollers of said stripper plates to insure the proper positioning of said feed wheel during inward movement of said cutter blade so that said cutter blade engages and cuts the bundle of yarns equidistance between adjacent pairs of said anvils.

12. A method for forming relatively short yarn bundles for use in making yarn balls while utilizing a series of successive work stations at which the various procedures incident to formation of the yarn bundles are performed, said method comprising the step of a. arranging a multiplicity of yarns into a generally parallel, composite arrangement, b. feeding the composite yarn arrangement in a step-by-step manner while successively gripping and confining the composite yarn arrangement at a plurality of spaced points therealong, the distance between said spaced points being equal to the desired length of the yarn bundles being formed, c. successively applying a binder element around the composite yarn arrangement at each of said gripped and confined spaced apart points along the length of the yarns, and d. severing the composite yarn arrangement between adjacent binder elements to form the composite yarn arrangement into relatively short yarn bundles.

13. A method according to claim 12 including the step of stripping the short yarn bundles from the gripped and confined condition maintained during said feeding step.

14. A method according to claim 13 including the step of applying suction currents to the stripped short yarn bundles and transporting the short yarn bundles to a collection point.

* * * * *

UNITED STATES PATENT OFFICE

CERTIFICATE OF CORRECTION

Patent No. 4,044,438 Dated August 30, 1977

Inventor(s) John R. Everhart

It is certified that error appears in the above-identified patent and that said Letters Patent are hereby corrected as shown below:

The following additional references should be included under "References Cited":

| | | | |
|---|---|---|---|
| 834,213 | 10/1906 | Maddox | 28/2 |
| 1,708,780 | 4/1929 | Rehfuss | 28/2 |
| 1,905,978 | 4/1933 | Arnold | 28/2 |
| 1,942,420 | 1/1934 | Gail | 28/2 |
| 2,033,655 | 3/1936 | Smith | 28/2 |
| 2,062,183 | 11/1936 | Lawson et al | 28/2 |

Column 6, Line 33, change "yarn" to -- yarns --;
Column 7, Line 20, change "bundles" to -- bundle --.

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*